US006776608B2

(12) United States Patent
Lasagni et al.

(10) Patent No.: US 6,776,608 B2
(45) Date of Patent: Aug. 17, 2004

(54) METHOD AND MEANS FOR A SECURITY CONTROL OF BURNERS

(75) Inventors: Feliciano Lasagni, Via Salvo D'Acquisto (IT); Maurizio Beghi, Via dei Panigarola (IT); Massimo Gilioli, Viale Valeggio (IT)

(73) Assignee: Worgas Bruciatori S.R.L., Formigine (IT)

( * ) Notice: Subject to any disclaimer, the term of this patent is extended or adjusted under 35 U.S.C. 154(b) by 0 days.

(21) Appl. No.: 09/525,501

(22) Filed: Mar. 15, 2000

(65) Prior Publication Data

US 2001/0051320 A1 Dec. 13, 2001

(30) Foreign Application Priority Data

Mar. 19, 1999 (IT) ..... MO99A000049

(51) Int. Cl.[7] ..... F23N 5/02

(52) U.S. Cl. ..... 431/6; 431/12; 431/69; 431/77

(58) Field of Search ..... 431/6, 12, 15, 431/27, 69, 77, 78, 79, 80

(56) References Cited

U.S. PATENT DOCUMENTS 3,589,847 A * 6/1971 Osborne ..... 431/69
4,768,947 A * 9/1988 Adachi ..... 431/80
5,393,222 A * 2/1995 Sutton ..... 431/80
5,645,411 A * 7/1997 Schaupert et al. ..... 431/80

FOREIGN PATENT DOCUMENTS

EP 757207 A1 * 2/1997
GB 2270748 A * 3/1994
JP 56-56529 A * 5/1981
JP 57-198921 * 12/1982 ..... 431/78
JP 62-266317 A * 11/1987

* cited by examiner

*Primary Examiner*—Sara Clarke
(74) *Attorney, Agent, or Firm*—Reising, Ethington, Barnes & Kisselle, P.C.

(57) ABSTRACT

A method for a security control of a burner, provided with a body comprising a diffuser in which apertures for the flow of a mixture of air and fuel are made, comprises detecting a temperature representative of the temperature of said diffuser in at least one zone of the diffuser, generating a signal having an intensity depending on said representative temperature. A security means for a security control of a burner comprises temperature detecting means capable of generating a signal having an intensity proportional to the temperature detected; said temperature detecting means being arranged in such a way as to detect a temperature having variations analogous to the variations of temperature of said diffuser in the area of the diffuser affected by said combustion

21 Claims, 3 Drawing Sheets

METHOD AND MEANS FOR A SECURITY CONTROL OF BURNERS

FIELD OF THE INVENTION

The invention concerns a method and means for a security control of burners, particularly gaseous fuel burners.

BACKGROUND OF THE INVENTION

From the prior art methods are known for controlling the ignition of burners, which use ionization sensors which detect whether the burner has been ignited. The ionization sensors detect a ionization current which is produced in the region of the flames generated near the surface of the burner diffuser by the combustion of the fuel which is fed to the burner. Said sensors are associated with security devices which, if there is no ionization current, that is if the fuel is not ignited during the ignition phase, or the flames are extinguished during normal operation of the burner, cut off the fuel feeding of the burner, in order to prevent fuel feeding to be continued if the ignition has not taken place, which could lead to dangerous concentrations of unburnt fuel in the combustion chamber, with a serious danger of fire or and/or explosion.

The security device may be set in such a way as to start, or restart, the ignition phase of the burner after a preestablished period of time has elapsed from the cut-off of the fuel feeding and to try again a preestablished number of times to start the burner before generating a signal of malfunction of the burner, in the event of failure of all the attempts of ignition.

The above mentioned methods, however, are not capable of detecting abnormal situations during the operation of the burner, such as, for instance, overheating of the burner, or an operative condition in which the temperature of the burner diffuser is lower than a preestablished optimal temperature, which implies usually the formation of quantities of CO and unburnt matters greater than optimal quantities.

Methods for controlling a burner are also known, wherein the feeding of the burner is controlled according to preestablished parameters, for instance the thermal power which is to be supplied to a heating plant and the temperature of the water in the water feeding the heating plant.

The above mentioned methods are not satisfactory, because the boiler is controlled without taking into account the actual operative conditions of the burner.

SUMMARY OF THE INVENTION

This invention intends to provide a method and means for a security control of a burner which are simple, reliable, less costly and capable of detecting not only ignition failures of the burners, but also abnormal operative conditions.

According to a first aspect of the present invention there is provided a method for a security control of a burner provided with a body comprising with a diffuser in which apertures for the flow of a mixture of air and fuel are made, said method comprising feeding the burner with a flow of fuel, interacting with said fuel with means capable of causing the combustion of the fuel, changing the rate of flow of said fuel, characterized in that it further comprises detecting a temperature representative of the temperature of of a surface of said diffuser in at least one zone of the diffuser, generating a signal having an intensity depending on said representative temperature.

According to another aspect of the present invention, there are provided security means for a security control of a burner including a body provided with a diffuser in which apertures for the flow of a mixture of air and fuel are made, said burnr being associated with feeding means capable of feeding the burner with a flow of fuel, ignition means capable of interacting with said fuel to cause the combustion thereof, control means capable of changing the rate of flow of said fuel, characterised in that said security means comprises temperature detecting means capable of detecting a temperature representative of the temperature of at least one zone of the surface of said diffuser and generating a signal having an intensity depending on said representative temperature.

BRIEF DESCRIPTION OF THE DRAWINGS

An exemplifying, but not limiting, embodiment of the invention will be described here below, with reference to the enclosed drawings, in which.

DETAILED DESCRIPTION OF THE PREFERRED EMBODIMENTS

Figure 5:
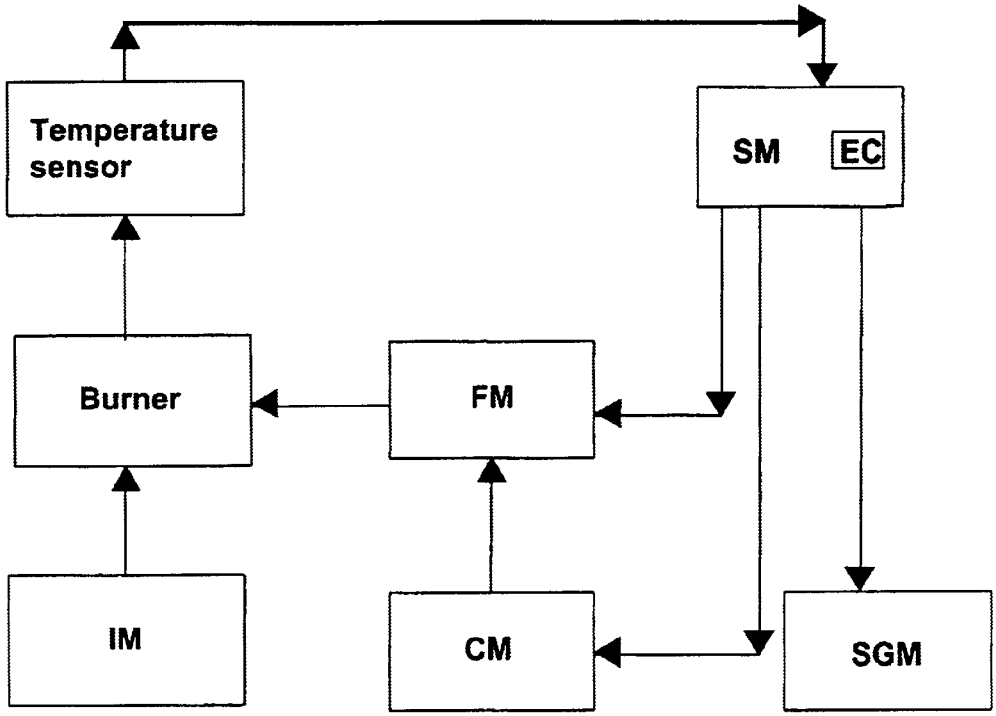
FIG. 5 is a block diagram illustrating how the invention works.

The burner according to the invention comprises a body 1 provide with a diffuser 2 in which apertures 3 are made for the flow an the subsequent combustion of a mixture of air and fuel fed to the burner body through feeding means FM (FIG. 5) and ignited by ignition means IM associated with the burner.

The combustion of the mixture of air and fuel generates a plurality of flames 5 connected with the apertures 3 made on the diffuser 2 of the burner. In an area of the burner close to the apertures 3 a temperature sensor 4, 4*a* is arranged, for instance a thermocouple, which detects the temperature of the surface of the diffuser 2 in said area and generates a signal, for instance an electric signal, depending on the temperature detected. The position of the sensor 4, 4*a* is chosen in such a way as the variations of the temperature detected by the sensor are analogous to the variations of the temperature of the diffuser 2 in the area of flames, that is in the area involved in the combustion of the mixture of air and fuel during the operation of the burner. For instance, the sensor 4 may be arranged between two rows of slots 3, or the sensor 4*a* may be arranged outside the rows of slots 3.

In addition, the sensor 4*b* may be arranged close to the surface of the burner, without being in contact with said surface directly, or by means of a coupling element. In that event, the sensor 4*b* may consist of a metallic element associated with a thermocouple. Thus, the thermocouple of the sensor 4*b* measure the temperature of the metallic element of the sensor 4*b*, the variations of said temperature being, in any event, analogous to the variations of the temperature of the surface of the burner, in the area of flames.

The sensor 4, 4*a*, 4*b* is operatively connected to a survey means SM (FIG. 5) capable of controlling control means CM for changing the rate of flow of the fuel and/or of the air introduced into the body 1 of the burner by feeding means FM. The security means may comprise an electronic card EC.

Figure 3:
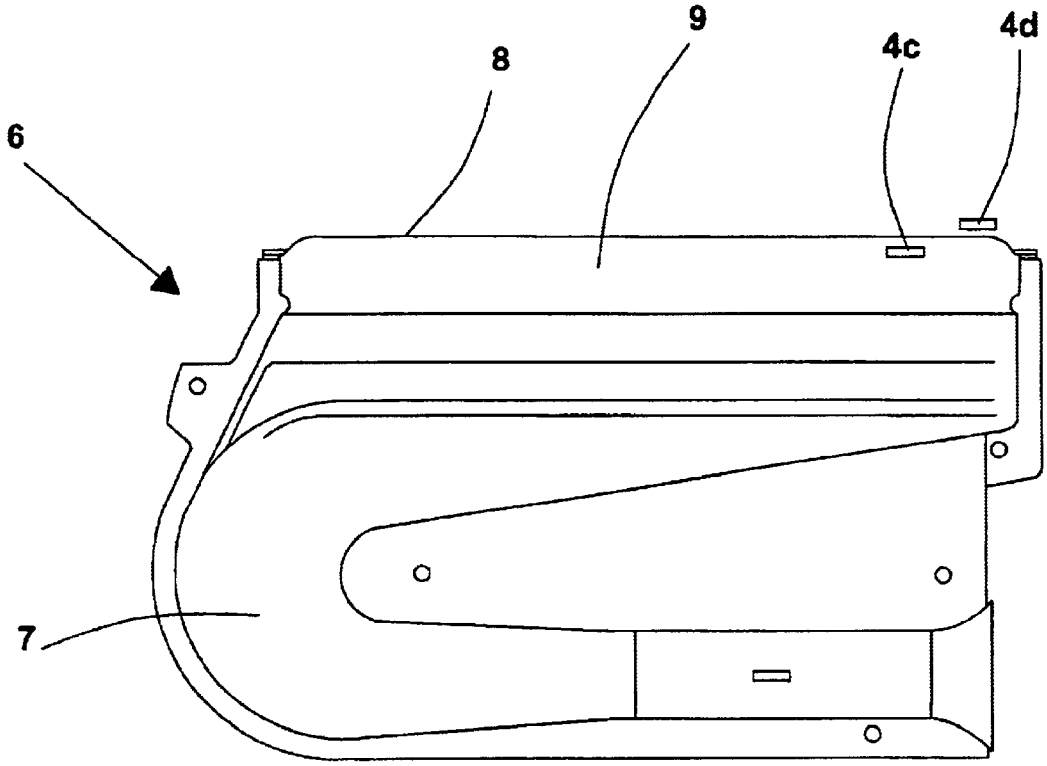
FIG. 3 is a side view of a so-called modular blade burner provided with the security control means according to the invention.
Figure 4:
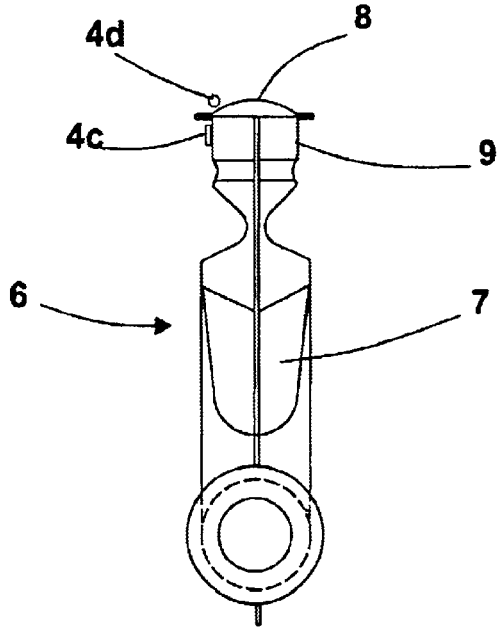
FIG. 4 is a view from right of FIG. 3.

FIGS. 3 and 4 illustrate a burner 6 of a so-called modular blade type, provided with a body 7 consisting of two symmetrical halves and ending with a top head 8, constituting the diffuser of the burner, in which apertures for the flow of the mixture of air and fuel introduced in the burner are made. A sensor 4*c,* analogous to the sensor 4, or 4*a,* may be applied on the side wall 9 of the head 8, which allows the sensor to react quickly to the variations of the combustion conditions of the burner. Alternatively, a sensor 4*d,* analogous to the sensor 4*b* may be arranged close to the surface of the burner without being in contact with it directly. The sensor 4*a,* 4*b,* 4*c* may be a wire, or strand, thermocouple. The thermocouple may be coupled to the burner body by means of direct welding or mechanical coupling means.

Said coupling means may comprise, for instance:

a male metallic coupling element, for instance a male fast coupling element, welded or riveted on the surface of the burner, and a female coupling element, for instance a female fast coupling element, to which the thermocouple is fasten;

a metallic eyelet riveted or screwed on the surface of the burner, the thermocouple being fastened to the eyelet;

a metallic plate applied on the surface of the burner, to which the thermocouple is fastened.

When the burner is started, if the ignition of the mixture of air and fuel flowing through the apertures 3 takes place regularly, the temperature detected by the temperature sensor 4, 4*a,* 4*b,* 4*c,* 4*d* increases progressively until it reaches and exceeds, in a certain time interval, a first preestablished value of temperature stored in the electronic card EC of the survey means SM. If, on the contrary, the ignition of the mixture does not take place the temperature detected by the sensor remains lower than said first preestablished value. When a preestablished time interval has elapsed—said time interval being typical of each application and depending, for instance, on the thermal inertia of the burner, on the dimension of the combustion chamber, etc.—from the starting of the ignition of the burner and the temperature detected by the sensor 4, 4*a,* 4*b,* 4*c* has not exceeded said first preestablished value, the electronic card EC cut-off the feeding of the fuel to the burner, because the fact that the first preestablished temperature has not been exceeded in said preestablished time interval shows that the burner has not been ignited.

The electronic card EC may be set in such a way as to repeat the ignition of the burner when a second preestablished time interval has elapsed from the cut-off of the fuel feeding at the end of the first ignition attempt.

If a further ignition failure occurs, the ignition procedure may be repeated a preestablished number of times.

If all the ignition attempts fail, the electronic card EC activate signal means SGM which generates a malfunction signal indicating a malfunction of the burner and/or of the feeding an control systems in general.

If the burner is regularly ignited, but, during the operation of the burner, an overheating of the diffuser occurs, that is if the temperature detected by the sensor 4, 4*a,* 4*b,* 4*c,* 4*d* exceeds a second preestablished value, the electronic card EC activates a second malfunction signal of the signal means SM and causes a reduction of the rate of flow of the fuel introduced in the body 1 of the burner, and/or an increase of the combustion air. When a second preestablished time interval has elapsed, if the temperature detected by the sensor 4, 4*a,* 4*b,* 4*c,* 4*d* does not fall below said second preestablished temperature, the electronic card EC causes the cut-off of the feeding of the burner 1, in order to avoid damages caused by an overheating of the diffuser for a too long time.

On the contrary, if after the ignition of the burner the temperature detected by the sensor 4, 4*a,* 4*b,* 4*c,* remains lower than a third preestablished temperature, corresponding to an optimal operation temperature, for a third preestablished time interval, the electronic card EC activates a still further signal of the signal means SGM indicating a malfunction of the burner.

Finally, if during the operation of the burner an unwanted interruption of the combustion of said mixture occurs, the electronic card EC cuts-off the feeding of the fuel and activate the signal indicating a burner malfunction, as soon as the temperature of the diffuser falls below said first preestablished value.

In such a way, it is possible to obtain a simple and efficient automatic security control of the operation of the burner and of the plant of which the burner is part.

The above mentioned preestablished values of temperature may be invariable or may depend on the operative parameters of the burner (for instance power, gas feeding pressure, or other parameters).

Figure 1:
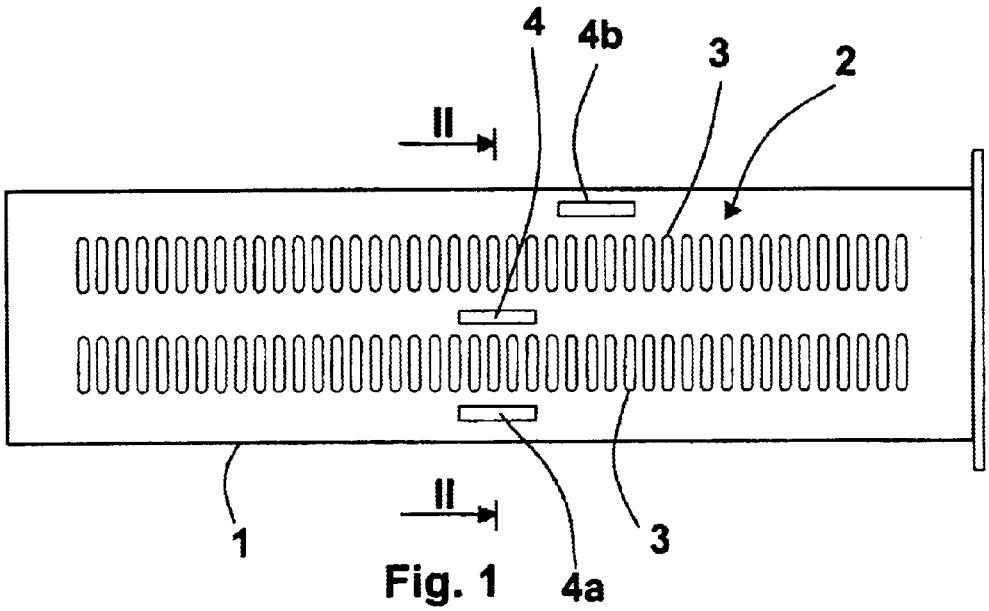
FIG. 1 is a top view of a tubular burner provide with the security control means according to the invention.
Figure 2:
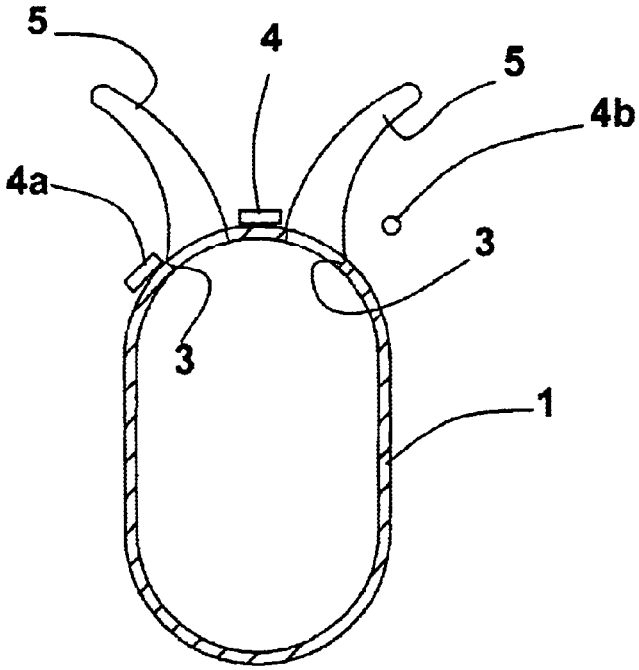
FIG. 2 is a section II—II of FIG. 1.

The shape and arrangement of the apertures 3 shown in FIG. 1 is merely exemplifying, but not limiting, it being possible to adopt any other shape and arrangement of the apertures on the diffuser 2. In addition, the position of the temperature sensor 4, 4*a,* 4*b,* 4*c,* 4*d* shown in FIG. 1, is only exemplifying, but not limiting, the position of the sensor being chosen in such a way as the temperature detected follows the changes of the temperature of the surface of the diffuser 2 in the area of the flames, during operation of the burner.

What we claim is:

1. A security means for a security control of a burner provided with a body having a diffuser carrying a plurality of apertures for the flow of a mixture of air and fuel, the security means comprising:

a feeding means constructed and arranged to feed said burner with a flow of fuel;

an ignition means constructed and arranged to cause combustion of said fuel;

a control means constructed and arranged to change the flow of said fuel;

a temperature sensor of the security means constructed and arranged to generate a signal having an intensity proportional to a temperature detected;

wherein said temperature sensor has a position arranged to detect a temperature having variations analogous to the variations of the temperature of a surface of said diffuser in an area of the diffuser affected by said combustion; and wherein said position is a position close to the surface of said diffuser, but not in contact with said surface.

2. The security means according to claim 1, wherein said signal is an electric signal.

3. The security means according to claim 1 comprising at least one thermocouple of the temperature sensor.

4. The security means according to one of claim 3, wherein said temperature detecting means are operatively associated with said control means and with a survey means.

5. The security means according to claim 1, wherein said temperature sensor is operatively associated with said control means and with a survey means.

6. The security means according to claim 5, wherein said control means and said survey means are capable of interacting with said feeding means.

7. The security means according to claim 6, wherein said survey means are capable of activating signal means capable of indicating a malfunction of the burner.

8. The security means according to claim 5, wherein said survey means comprises an electronic card.

9. A security means for a security control of a burner provided with a body having a diffuser carrying a plurality of apertures for the flow of a mixture of air and fuel, the security means comprising:

a feeding means constructed and arranged to feed said burner with a flow of fuel;

an ignition means constructed and arranged to cause combustion of said fuel;

a control means constructed and arranged to change the flow of said fuel a temperature sensor of the security means constructed and arranged to generate a signal having an intensity proportional to a temperature detected;

wherein said temperature sensor is arranged at the surface of said diffuser and has a position orientated to detect a temperature having variations analogous to the variations of the temperature of a surface of said diffuser in an area of the diffuser affected by said combustion;

wherein said temperature sensor has at least one thermocouple; and wherein said thermocouple is coupled with the body of the burner by means of welding.

10. The security means according to claim 9 wherein said temperature detecting means are operatively associated with said control means and with a survey means.

11. A security means for a security control of a burner provided with a body having a diffuser carrying a plurality of apertures for the flow of a mixture of air and fuel, the security means comprising:

a feeding means constructed and arranged to feed said burner with a flow of fuel;

an ignition means constructed and arranged to cause combustion of said fuel;

a control means constructed and arranged to change the flow of said fuel;

a temperature sensor of the security means constructed and arranged to generate a signal having an intensity proportional to a temperature detected;

wherein said temperature sensor is arranged at the surface of said diffuser and has a position orientated to detect a temperature having variations analogous to the variations of the temperature of a surface of said diffuser in an area of the diffuser affected by said combustion;

wherein said temperature sensor has at least one thermocouple; and wherein said thermocouple is coupled with the body of the burner by means of mechanical coupling means.

12. The security means according to claim 11 wherein said temperature detecting means are operatively associated with said control means and with a survey means.

13. A method for a security control of a burner provided with a body having a diffuser which carries a plurality of apertures through which a mixture of air and fuel flows, said method comprising the steps of:

feeding the burner with a flow of fuel;

causing the combustion of the fuel;

changing the rate of flow of said fuel;

detecting a temperature, the variations of which are analogous to the variations of the temperature of said surface in an area of the diffuser affected by said combustion, said detecting being obtained using a temperature sensor arranged at the surface of said diffuser;

generating a temperature signal having an intensity depending on said temperature, said signal being generated by said temperature sensor; and changing the rate of flow of said fuel depending on the intensity of said signal, wherein said temperature sensor is arranged in a position close to the surface of said diffuser, but not in contact with said surface.

14. The method according to claim 13, further comprising the step of cutting-off said flow of fuel if the intensity of said temperature signal does not reach a first pre-established value in a first pre-established time interval, during a starting phase of the burner operation.

15. The method according to claim 14, further comprising the step of cutting-off said flow of fuel if the intensity of said temperature signal falls below said first pre-established value after said starting phase.

16. The method according to claim 14 further comprising the step of activating a signal indicating a malfunction of the burner.

17. The method according to claim 15 further comprising the step of activating a signal indicating a malfunction of the burner.

18. The method according to claim 13, further comprising the step of reducing said rate of flow of fuel if the intensity of said temperature signal exceeds a second pre-established value.

19. The method according to claim 18, further comprising the step of activating a second signal indicating a malfunction of the burner.

20. The method according to claim 18, further comprising the step of cutting-off said flow of fuel if the intensity of said temperature signal remains higher than said second pre-established value during a second pre-established time interval.

21. The method according to claim 13, further comprising the step of activating a still further signal indicating a malfunction of the burner if, after a starting phase of the burner, the intensity of said signal remains lower than a third pre-established value during a third pre-established time interval.

* * * * *

UNITED STATES PATENT AND TRADEMARK OFFICE

CERTIFICATE OF CORRECTION

PATENT NO. : 6,776,608 B2
DATED : August 17, 2004
INVENTOR(S) : Feliciano Lasagni et al.

It is certified that error appears in the above-identified patent and that said Letters Patent is hereby corrected as shown below:

Column 1,
Line 24, after “of fire” delete “or”
Line 62, after “of the temperature” delete “of”

Column 2,
Line 3, after “said” delete “burnr” and insert -- burner --
Line 18, after “tubular burner” delete “provide” and insert -- provided --
Line 33, after “the flow” delete “an” and insert -- and --
Line 57, after “sensor 4b” delete “Measure” and insert -- Measures --

Column 3,
Line 51, after “card EC” delete “activiate” and insert -- activates --
Line 59, after “signal means” delete “SM” and insert -- SGM --

Column 4,
Line 11, after “and” delete “activiate” and insert -- activates --

Column 5,
Line 12, after “change the flow of said fuel”, insert -- ; --

Signed and Sealed this

Twenty-second Day of February, 2005

JON W. DUDAS
*Director of the United States Patent and Trademark Office*